United States Patent [19]

Farrell, Jr.

[11] 4,271,556

[45] Jun. 9, 1981

[54] PIPE CLEANING APPARATUS

[76] Inventor: Eugene C. Farrell, Jr., 434 70th Ave., East Moline, Ill. 61265

[21] Appl. No.: 46,878

[22] Filed: Jun. 8, 1979

[51] Int. Cl.[3] ..... B08B 9/02

[52] U.S. Cl. ..... 15/104.3 R; 15/104.12; 15/104.13

[58] Field of Search ..... 15/104.09, 104.12, 104.13, 15/104.14, 104.3 R

[56] References Cited

U.S. PATENT DOCUMENTS

| | | | |
|---|---|---|---|
| 230,588 | 7/1880 | Taft et al. | 15/104.12 |
| 940,150 | 11/1909 | Hauer | 15/104.12 |
| 1,584,740 | 5/1926 | Denny | 15/104.12 X |
| 2,218,130 | 10/1940 | Court | 15/104.12 |

*Primary Examiner*—Edward L. Roberts

*Attorney, Agent, or Firm*—Henderson & Sturm

[57] ABSTRACT

A pipe such as a sewer line or the like is cleaned by advancement therethrough of a rigid tubular member having at its lead end a nozzle for ejecting a stream of water to dislodge debris, etc., followed by a series of rotary cutters and pushes for removing more stubborn foreign materials.

5 Claims, 4 Drawing Figures

PIPE CLEANING APPARATUS

BRIEF SUMMARY OF THE INVENTION

Various types of apparatus and systems are known for the repair and cleaning of sewer lines and the like, but most of these lack in one phase or another, such as versatility, reasonable cost, ease of operation, maintenance etc. According to the present invention, the sewer or like line is cleaned of debris and other foreign materials by a unit comprising a rigid tubular member having at its front end a nozzle for ejecting water under pressure. The member is elongated and at its trailing end may be easily connected to a hydrant or other source of pressurized water. Behind the nozzle and coaxial with the member is a relatively small rotary cutter for dislodging stubborn debris such as roots, deposits, etc., and this cutter is followed by a coaxial circular pusher for advancing the dislodged debris. This pusher is in turn followed by a second, larger rotary cutter and in turn by a larger pusher and so on, assuring that the entire inside diameter of the line is accommodated. The cutters are air-driven and the air line is disposed within the member and externally connected to jets for driving the cutters.

In the cleaning operation, the unit is advanced by tying to its rear end supplemental, removable tubular extensions, and the unit may be advanced and withdrawn by power means, preferably an air jack.

DESCRIPTION OF THE DRAWINGS

FIG. 1 is an elevation of the cleaning apparatus shown within a typical sewer line or the like.

DETAILED DESCRIPTION

Figure 1:
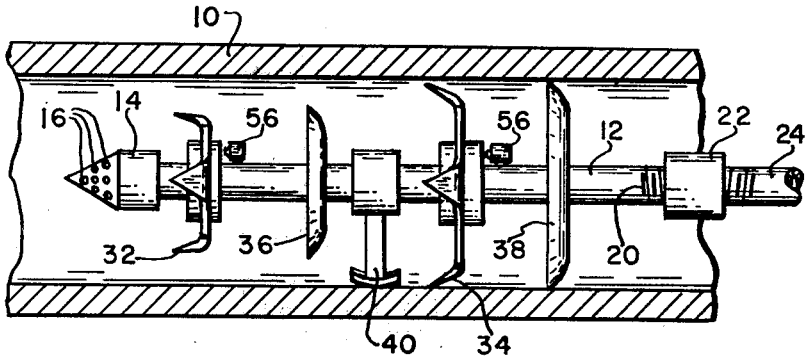
Figure 3:
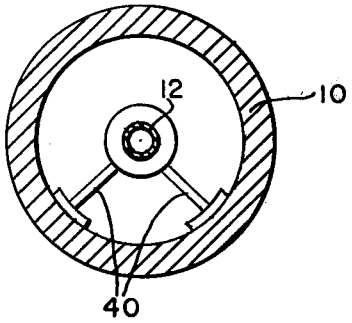
FIG. 3 is an end view showing the support and guide means for the apparatus.
Figure 4:
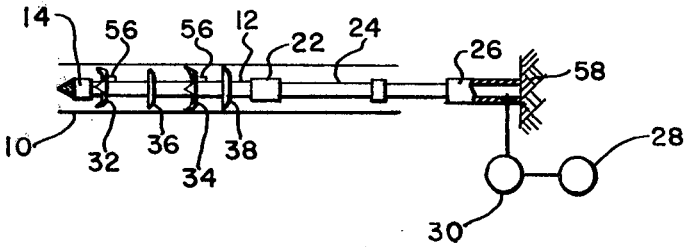
FIG. 4 is a reduced, schematic how the apparatus may be advanced through the line.

A typical sewer pipe or line is shown at 10 in FIGS. 1 and 4. The apparatus for cleaning the line of debris, etc. includes an elongated, rigid tubular member 12 shown as having been inserted coaxially into the line and having a front end fitted with a conical ejector 14 formed with a plurality of perforations or orifices 16 for emitting or ejecting water from a source, such as a typical hydrant 18 (FIG. 3) connected in any suitable manner to the rear end of the tubular member 12. This rear end may be threaded at 20 to receive a coupling 22 by means of which extension tubes 24 may be added as the unit progresses axially through the line (to the left as seen in the drawings). Axial forces may be applied to the tubular member (and its extensions) by any known means, such as an air jack or ram 26 connected to a source of pressure 28 and controlled by a valve 30 (FIG. 4). From the description thus far, it will be seen that hydrant (or equivalent) water under pressure is supplied to the rear end of the tubular member and/or its extensions and is forcefully ejected at the orificed cone 14, serving to dislodge all but the most stubborn debris, which is thus flushed out and into the larger main line (not shown).

For more stubborn blockages, for example, root and the like, the tubular member 12 is equipped with rotary cutters 32 and 34 and circular pushers 36 and 38. The unit is supported and guided through the line by appropriate means such as a pair of angularly related skids 40. Although only two cutters are shown, several may be employed, increasing in diameter from front to rear. By way of example, the front or forward cutter 32 is shown as being somewhat smaller than the next rearward cutter 34 for the purpose of taking relatively small but effective bites out of the foreign matter, debris, roots, etc. The larger cutter then enlarges the path made by the next forward cutter and so on.

Figure 2:
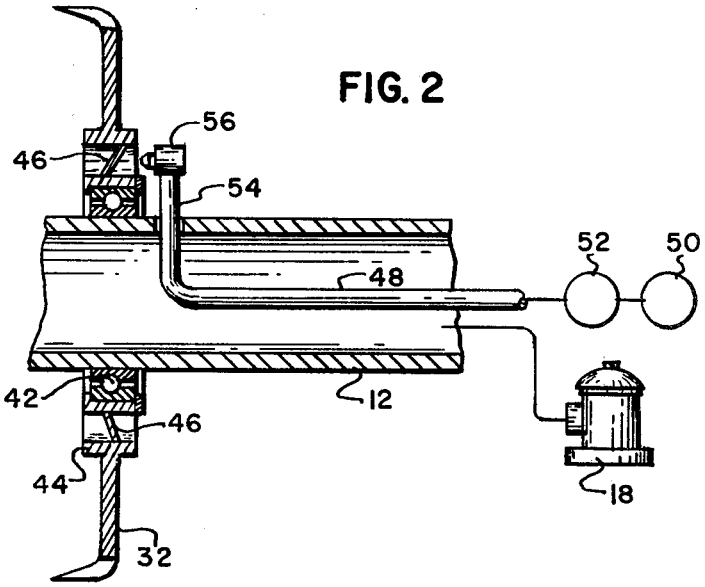
FIG. 2 is an enlarged view showing the manner of driving one of the rotary cutters.

Each cutter is air-driven, and, since both cutters are the same in this respect, only the cutter 32 will be described in detail (FIG. 2), it being understood that what is said applies also to the cutter 34 and so on. The cutter 34 is rotatably carried by the member 12 by an anti-friction bearing 42 and has an annulus 44 surrounding the outer race of the bearing and equipped with a plurality of vanes or blades 46. An air conduit 48 is disposed within the member 12 and is connected to any suitable source of air pressure, as at 50 controlled by a valve 52. Just rearwardly of each cutter, the air conduit has a radial branch 54 extending out through the member 12 in water-tight fashion and terminating in a jet 56 directed forwardly against the vanes in the adjacent cutter, thus serving as means for rotating the cutter.

Each pusher 36, 38 is dimensioned according to its companion cutter and serves to push freed debris ahead of it, getting it out of the way of succeeding cutters.

As the unit is advanced into the line, more extensions such as the extension 24 may be added by couplings like that at 22. The air conduit is made sufficiently long to accommodate the advance of the unit. When the task is completed, the unit may be retracted and the water pressure relied upon to flush out all loosened debris. Retraction is accomplished by retracting the air jack, which may have any suitable clamp (not shown) attached thereto to grip the member and its extensions. As suggested in FIG. 4, the jack may be anchored to existing adjacent structure 58.

I claim:

1. Apparatus for cleaning a sewer line or the like, comprising: an elongated, rigid tubular member adapted to be inserted coaxially into the line and having front and rear ends; means at the rear end of the member for connection to a source of water under pressure; means at the front end of the line for ejecting water under pressure to the line ahead of the member; rotary cutter means coaxially journaled on the member rearwardly of the water-ejecting means; a conduit disposed within the member and having a jet extending radially through the member behind the cutter, said conduit having a rear end connectible to a source of air under pressure for pressurizing the jet; and impeller means at the rear of and connected to the cutter for receiving air under pressure from the jet to rotate the cutter.

2. The apparatus of claim 1, further comprising: a second rotary cutter means coaxially journaled on the member rearwardly of the first-mentioned cutter, said second cutter means having impeller means at its rear; and a second jet connected to the air conduit and extending radially through the member to act on the second impeller for rotating the second cutter means.

3. The apparatus of claim 1, further comprising: pusher means carried by and externally of the conduit behind the jet for pushing debris dislodged by the cutter means.

4. The apparatus of claim 1, further comprising: means at the rear of the member for advancing and retracting the member relative to the line.

5. The apparatus of claim 4, further comprising: removable extension means selectively connectible to and removable from the member at its rear end between said rear end and the advancing and retracting means to enable selective lengthening and shortening of the member.

* * * * *